United States Patent [19]

Barreau et al.

[11] Patent Number: 5,071,475

[45] Date of Patent: Dec. 10, 1991

[54] PROCESS FOR PREPARING METALLIC MERCURY FROM CALOMEL

[75] Inventors: Guy Barreau, Calas; Claude Eusebe, Douai, both of France

[73] Assignee: Vieille-Montagne France S.A., Cedex, France

[21] Appl. No.: 572,226

[22] Filed: Aug. 24, 1990

[30] Foreign Application Priority Data

Apr. 13, 1990 [FR] France ..... 90-04-830

[51] Int. Cl.[5] ..... C22B 3/00

[52] U.S. Cl. ..... 75/670

[58] Field of Search ..... 75/670

[56] References Cited

U.S. PATENT DOCUMENTS

| | | | |
|---|---|---|---|
| 3,039,865 | 6/1962 | Gilbert et al. | 75/81 |
| 3,537,843 | 11/1970 | Jacobowsky | 75/670 |
| 3,788,842 | 1/1974 | Nolte et al. | 75/109 |
| 3,847,598 | 11/1974 | Coulter et al. | 75/121 |
| 3,849,537 | 11/1974 | Allgulin | 423/210 |
| 4,233,274 | 11/1980 | Allgulin | 423/210 |
| 4,640,751 | 2/1987 | Dyvik et al. | 204/105 R |

FOREIGN PATENT DOCUMENTS

| | | |
|---|---|---|
| 0179040 | 4/1986 | European Pat. Off. . |
| 2163599 | 7/1972 | Fed. Rep. of Germany . |
| 2102900 | 8/1972 | Fed. Rep. of Germany . |

*Primary Examiner*—Peter D. Rosenberg

*Attorney, Agent, or Firm*—Richard C. Litman

[57] ABSTRACT

The invention provides a process and an installation for producing mercury by reduction of calomel by implementing a process for preparing metallic mercury, said installation essentially comprising: a reaction vessel with an inclined base for the reduction provided with an agitator, connected by a conduit to said decanter and provided with water supply means and sulfuric acid supply means, and a mercury recovery tank connected to the lower part of the reaction vessel.

10 Claims, 2 Drawing Sheets

PROCESS FOR PREPARING METALLIC MERCURY FROM CALOMEL

BACKGROUND OF THE INVENTION

The present invention relates to a process for producing metallic mercury from mercurous chloride commonly known as calomel, an installation for carrying out this process, and to metallic mercury obtained in this way.

It is known that the mercury contained in sulfur-containing minerals, such as blende or pyrites, is volatilised during roasting of these minerals and that it is encountered in its elementary form in the sulfur-containing gases produced by the roasting. As these gases are then employed for the manufacture of sulfuric acid, this latter will contain the mercury thus entrained by volatilisation, which will then be encountered in fertilizers, or others products that enter into the food chain, in the manufacture of which the thus products sulfuric acid is employed. For this reason, the presence of mercury in sulfur-containing gases is undesirable and the content thereof needs to be limited in the roasting gases.

The most frequently used process for washing the gases is known under the name of the "Boliden Norzink process", taught for example in U.S. Pat. Nos. 3,849,537 and 4,233,274 and described in a large number of publications. In accordance with this process, the gases to be purified are washed in a tower in which a reaction take place between the metallic mercury of the gas and the $Hg^{++}$ mercuric ions in solution in the liquid phase from washing; this produces a very slightly soluble mercurous compound $Hg_2Cl_2$. The calomel thus producted can be decanted and extracted from the system. This process which allows 99.9% purification to be obtained gives satisfactory results but suffers from the drawback of giving rise to the production of calomel, the market outlets for which are extremely limited and which, moreover, because of its volatility, is not an ideal material for subsequent treatment in conventional mercury production plants. Moreover, the amount of calomel that can be stored is limited by statutory regulations.

The aim of the present invention is to provide a simple process that can be directly integrated into a mineral roasting process, for producing metallic mercury of greater than 99.999% purity, for which there are appreciable market outlets and which as the advantage of being able to be stored in a small volume by using suitable packagings.

SUMMARY OF THE INVENTION

The present invention provides a process of the above cited type in which the preparation of metallic mercury from calomel $Hg_2Cl_2$, the improvement consisting in that the calomel, preferably in the form of a suspension, is reduced by the action of a powder of a reducing metal that does not form an amalgam with the mercury and in that the mercury formed comes out as a precipitate.

In one embodiment of the present invention, the suspension is agitated during the reduction operation.

According to a further embodiment, the powder of a reducing metal is an iron powder and the amount of reducing iron employed varies between 1.5 and 1.7 times the stoechiometric amount corresponding to that for the reaction:

$$2Hg^{+}+Fe \rightarrow 2Hg+Fe^{++}$$

In a further embodiment of the invention, the pH of the solution is maintained at a value of the order of 0.5 by adding sulfuric acid.

The conditions for obtaining a good yield from the process involve the quality and quantity of the metallic powder which is used as well as the operating conditions that should be adhered to, in particular the acidity, which lead to correct coalescence of the mercury formed while avoiding formation of residue or of amalgam or of foams at the beginning of the reaction.

In accordance with a further feature of the present invention, the duration of agitation is at least 8 hours.

The force applied and the duration of agitation should be carefully determined bearing in mind the suspension employed and the size of the industrial installation since the effectiveness of such agitation is a predominating condition for good running of the process.

The present invention also provides a process for preparing metallic mercury from $Hg_2Cl_2$, wherein the calomel is in suspension in an acidic aqueous solution, in that the reducing metal is added in powder form, in that the suspension is agitated, and in that it is left to rest in order to allow the mercury to coalesce and to precipitate.

The present invention also relates to a process wherein the aqueous solution containing the precipitate of mercury is covered with a film of nitric acid, in that compressed air is caused to bubble into this solution, in that the thus treated mercury is collected and then passed through a film of nitric acid in water or an acid solution and, finally, caused to trickle in a finely divided state, in a column carrying baffles and filled with dilute nitric acid before being collected in the purified state. The nitric acid employed is 20% nitric acid.

The present invention also provides an installation for producing mercury by reduction of calomel by carrying out the process described above, comprising:

a reaction vessel with an inclined base for the reduction provided with an agitator, connected by a conduit to said decanter and provided with water supply means and sulfuric acid supply means; and a mercury recovery tank connected to the lower part of the reaction vessel.

In accordance with one embodiment of the above said installation, the latter further comprises:

a first tank provided with means for introducing compressed air for bubbling;

a second tank joined to this first one by a supply conduit; and a trickle column provided with baffles, carrying at the top thereof means for introducing finely divided mercury originated from said second tank and provided at its bottom with a conduit for removing the washed mercury and the lower compartment of which, filled with mercury, acts as a hydraulic trap.

As has already been said, the process according to the invention can constitute a phase that is carried out subsequent to the mineral roasting operation, followed by a phase for decanting the roasting gas washing solution; the decanted calomel is introduced directly into the reducing reaction vessel.

Others aims, advantages and characteristics will become more clear from the description that follows of one embodiment of an installation for reducing and purifying mercury according to the invention, provided by way of non-limitative illustration with reference to the appended drawing in which:

DETAILED DESCRIPTION OF A PREFERRED EMBODIMENT

Figure 1:
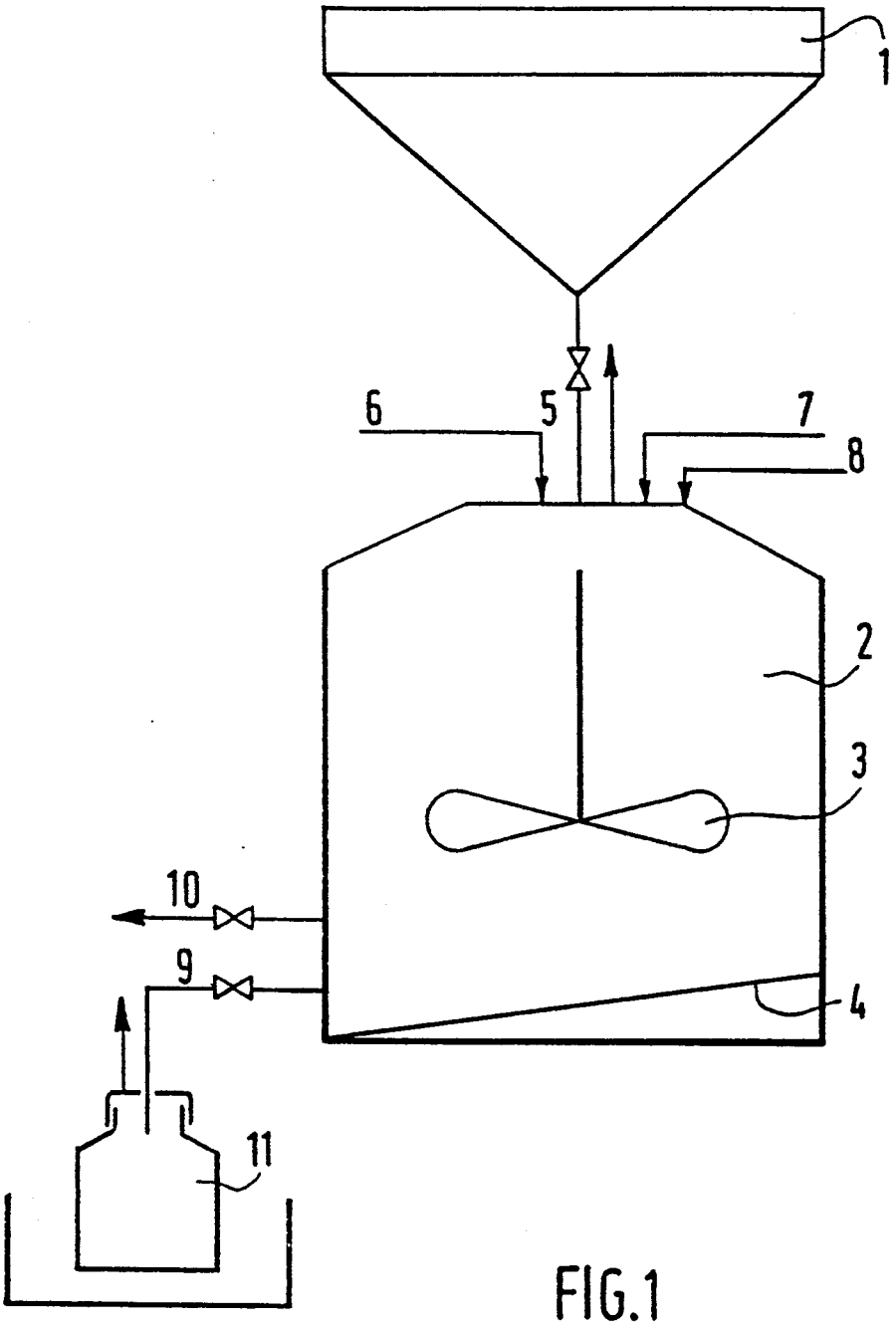
FIG. 1 shows an installation for reducing calomel.

The installation for producing mercury metal or mercury in metallic form which is shown schematically in FIG. 1 is associated with a decanter 1 and includes a reaction vessel 2 provided with an agitator 3 and an inclined base 4. The reaction vessel has supply inlets for the calomel at 5, for metallic powder at 6, and for sulfuric acid and water or acid solution at 7 and 8, respectively.

Calomel originating from a gas washing installation for example one employing the Boliden Norzink process, is extracted from the decanter 1 and introduced directly into the reaction vessel 2 which is agitated and keept at a negative pressure.

After preliminary agitation, a sample that is representative of the suspension is drawn off in order to enable the amount of metallic powder to be added to be calculated.

The pH of the solution is maintained at about 0.5 by injecting sulfuric acid, and agitation which is continued during 8 hours, after which agitation is terminated in order to allow the mercury to coalesce and to decant. After decantation, the mercury is extracted at the bottom of the vessel at 9 in order to be stored in the recipient 11, whilst the supernatant solution is drawn off at 10 in order to be neutralised with lime.

Figure 2:
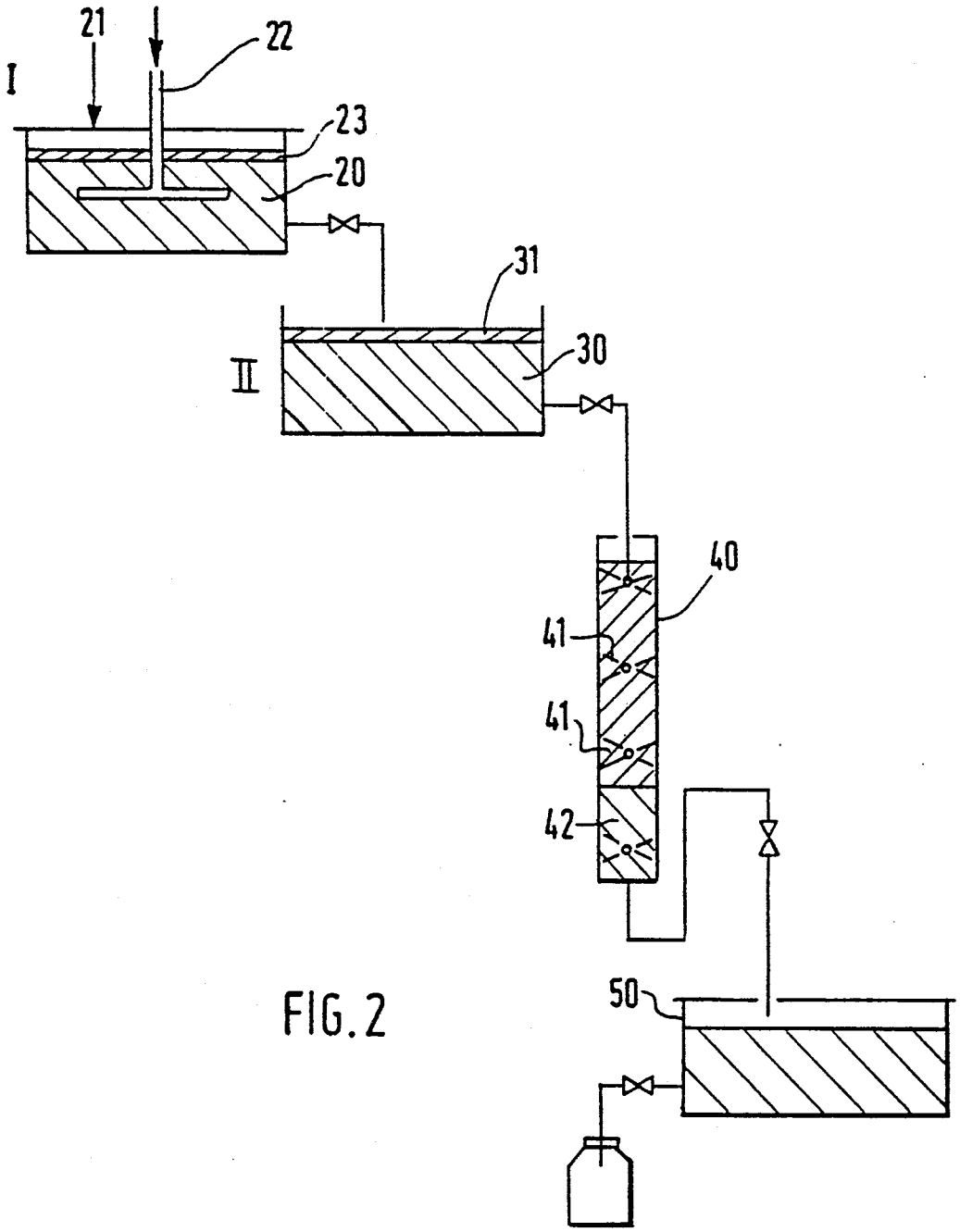
FIG. 2 shows an installation for purifying the mercury obtained in the above installation.

The mercury extracted from the reaction vessel at 9 can be purified by washing it with nitric acid in a washing installation one embodiment of which is shown schematically in FIG. 2.

The washing installation includes a first bubbling tank 20 filled with water or acid solution the surface of which is covered with a film 23 of nitric acid. A compressed air conduit 22 terminating at an elongated bubbling tube projects into the tank.

The first tank 20 is connected by a conduit to a second tank 30 filled with water or acid solution the surface of which is covered with a film of nitric acid 31.

The tank 30 is followed by a cascade type or baffled 41 trickle column 40 the bottom compartment 42 of which remains filled with mercury in order to act as a hydraulic trap.

A recipient 50 is used to store the purified mercury.

After having introduced the crude mercury into the tank 20 by conduit 21, bubbling is carried out with the compressed air in order to carefully wash the mercury and to rid it of impurities such as residues or amalgams. Following this, the mercury originating from the first tank is introduced into the second tank 30 after passing through the nitric acid film 31.

Finally, the finely divided mercury from tank 30 is introduced into the top of the trickle column 40 which carries baffles and is filled with nitric acid. The mercury that accumulates in the lower compartment 42 is progressively drawn off in order to be stored in recipient 50.

The thus purlfied mercury attains a purity that is greater than 99.999%.

The invention is not limited to the embodiments shown and described herein; many variants and modifications may be envisaged by those skilled in the art without departing from the spirit and scope on the invention as defined in the appended claims.

What is claimed is:

1. A process for preparing metallic mercury from mercurous chloride which comprises reducing a suspension of the mercurous chloride in an aqueous acidic solution with a powder of a reducing metal that does not form an amalgam with mercury and recovering the metallic mercury product as a precipitate.

2. The process according to claim 1, wherein the aqueous acidic solution is maintained at a pH of about 0.5 by adding sulfuric acid.

3. The process according to claim 1, wherein the metallic mercury product is purified by washing with nitric acid.

4. Process according to claim 1, wherein the suspension is agitated during the reduction operation.

5. Process according to claim 1, wherein the powder of a reducing metal is an iron powder.

6. Process according to claim 5, wherein the amount of reducing iron employed varies between 1.5 and 1.7 times the stoechiometric amount corresponding to that for the reaction:

$$2Hg^{+}+Fe \rightarrow 2Hg+Fe^{++}$$

7. Process according to claim 3, wherein the nitric acid employed is 20% nitric acid.

8. Installation for producing mercury by reduction of calomel by carrying out the process according to claim 1, wherein it comprises:

a reaction vessel (2) with an inclined base (4) for the reduction provided with an agitator (3), connected by a conduit (5) to said decanter (1) and provided with water supply means (7) and sulfuric acid supply means (8); and a mercury recovery tank (11) connected to the lower part of the reaction vessel.

9. Installation according to claim 8, wherein it further comprises:

a first tank (20) provided with means (22) for introducing compressed air for bubbling;

a second tank (30) joined to this first one (20) by a supply conduit; and a trickle column (40) provided with baffles (41), carrying at the top thereof means for introducing finely divided mercury originated from said second tank and provided at it bottom with a conduit for removing the washed mercury and the lower compartment (42) of which, filled with mercury, acts as a hydraulic trap.

10. Mercury obtained by carrying out the process according to claim 1.

* * * * *